US011642717B2

(12) United States Patent
Takahashi et al.

(10) Patent No.: US 11,642,717 B2
(45) Date of Patent: May 9, 2023

(54) PUNCHING DEVICE

(71) Applicant: Panasonic Intellectual Property Management Co., Ltd., Osaka (JP)

(72) Inventors: Masayuki Takahashi, Osaka (JP); Keitaro Fujii, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 205 days.

(21) Appl. No.: 17/231,001

(22) Filed: Apr. 15, 2021

(65) Prior Publication Data

US 2021/0323043 A1 Oct. 21, 2021

(30) Foreign Application Priority Data

Apr. 20, 2020 (JP) ..... JP2020-074944

(51) Int. Cl.
*B21D 28/18* (2006.01)
*B21D 28/14* (2006.01)

(52) U.S. Cl.
CPC ..... *B21D 28/18* (2013.01); *B21D 28/14* (2013.01)

(58) Field of Classification Search
CPC ..... B21D 28/14–22; B21D 28/24–26; B21D 37/04; B21D 37/06; B21D 37/08; B21D 37/10–12
See application file for complete search history.

(56) References Cited

U.S. PATENT DOCUMENTS 3,150,550 A * 9/1964 Berlin ..... B21D 37/205 83/13
3,908,500 A * 9/1975 Gargrave ..... B21D 37/14 83/563
3,969,928 A * 7/1976 Zarka ..... G01N 3/42 73/806
4,945,752 A * 8/1990 Stursberg ..... B21D 37/14 72/472
5,839,336 A * 11/1998 Yamauchi ..... B26F 1/14 83/167

(Continued)

FOREIGN PATENT DOCUMENTS

JP 6-238364 8/1994
JP 7-164075 6/1995

(Continued)

*Primary Examiner* — Jason Daniel Prone
*Assistant Examiner* — Richard D Crosby, Jr.
(74) *Attorney, Agent, or Firm* — McDermott Will & Emery LLP

(57) ABSTRACT

There is provided a punching device for punching a workpiece into a predetermined shape using a die and a punch, the device including: load sensors which measure a load in a punching direction at at least three predetermined points different from each other; and a control device that calculates a first moment, which is a sum of moments of the measured load around a first axis, and a second moment, which is a sum of moments of the measured load around a second axis, with respect to the first and second axes on a plane perpendicular to the punching direction, and determines that foreign matter is generated in a case where a magnitude of at least one of the first and second moments is deviated from a range of predetermined values.

6 Claims, 7 Drawing Sheets

(56) References Cited

U.S. PATENT DOCUMENTS

| | | | | |
|---|---|---|---|---|
| 5,941,111 | A * | 8/1999 | Skala | B21D 37/00 72/21.4 |
| 6,357,329 | B1 * | 3/2002 | Sakamoto | B21D 28/12 83/556 |
| 8,234,897 | B2 * | 8/2012 | Kuwayama | B21D 37/00 72/21.4 |
| 8,464,591 | B2 * | 6/2013 | Kuwayama | G01N 3/28 73/799 |
| 10,500,765 | B2 * | 12/2019 | Aitharaju | B29C 33/22 |
| 2010/0030362 | A1 * | 2/2010 | Paik | B21D 13/02 700/110 |
| 2010/0329755 | A1 * | 12/2010 | Obuchi | B26F 1/14 399/361 |
| 2015/0185094 | A1 * | 7/2015 | Kohler | G01L 1/16 73/774 |
| 2016/0193747 | A1 * | 7/2016 | Greenleaf | B26D 7/26 29/450 |
| 2018/0147617 | A1 * | 5/2018 | Villeneuve | B21D 37/14 |
| 2020/0269303 | A1 * | 8/2020 | Takahashi | G01L 5/167 |
| 2021/0078062 | A1 * | 3/2021 | Takahashi | G01L 5/0071 |

FOREIGN PATENT DOCUMENTS

| | | |
|---|---|---|
| JP | 2016-022486 | 2/2016 |
| JP | 2017-164751 | 9/2017 |

* cited by examiner

FIG. 7

| Number of punches | Moment difference | Determi-nation | Response |
|---|---|---|---|
| First | $\lvert Mx-Mx0 \rvert = 0.2(m \cdot N)$<br>$\lvert My-My0 \rvert = 0.0(m \cdot N)$ | OK | No response |
| Second | $\lvert Mx-Mx0 \rvert = 0.1(m \cdot N)$<br>$\lvert My-My0 \rvert = 3.0(m \cdot N)$ | NG | 1. Warning<br>2. Stop press device |
| Third | $\lvert Mx-Mx0 \rvert = 0.1(m \cdot N)$<br>$\lvert My-My0 \rvert = 0.4(m \cdot N)$ | OK | No response |
| ⋮ | ⋮ | ⋮ | ⋮ |

PUNCHING DEVICE

BACKGROUND

1. Technical Field

The present disclosure relates to a punching device for shearing a workpiece such as metal using a mold, and more specifically, to a punching device capable of detecting the generation of foreign matter.

2. Description of the Related Art

In the related art, in punching for shearing a workpiece using a die and a punch, foreign matter mixed between the die and the punch or between the punch and the workpiece causes a processing abnormality, which is a problem. In particular, the phenomenon called "scrap floating" is a phenomenon in which the scrap of the workpiece generated during punching is mixed as foreign matter between the die and the punch or between the punch and the workpiece as the punch rises, and it is well known that this phenomenon causes product defects and mold damage.

The punching device according to Japanese Patent Unexamined Publication No. 7-164075 is provided with a plurality of distance sensors around a mold for detecting a distance between an upper mold including a punch and a lower mold including a die, and in a case where a relationship between the detected values does not satisfy a predetermined reference, it is determined that foreign matter is mixed between the punch and the workpiece, an abnormality is output and detected by the operator, and the operation of the punching device is automatically stopped.

SUMMARY

According to one aspect of the present disclosure, there is provided a punching device for punching a workpiece into a predetermined shape using a die including a mold with a hole having the predetermined shape and a punch including a mold having the predetermined shape, the device including: load sensors which are disposed respectively at positions where a force applied to the die is transmitted in the punching device, and measure a load in a punching direction at each of at least three predetermined points different from each other in the die; and a control device that calculates a first moment, which is a sum of moments of the measured load around a first axis, and a second moment, which is a sum of moments of the measured load around a second axis, with respect to the first and second axes on a plane perpendicular to the punching direction, and determines that foreign matter is generated in a case where a magnitude of at least one of the first and second moments is deviated from a range of predetermined values.

BRIEF DESCRIPTION OF THE DRAWINGS

FIG. 7 is a view illustrating an example of a foreign matter detecting operation result table in the punching device of FIG. 1.

DETAILED DESCRIPTION

Figure 1:
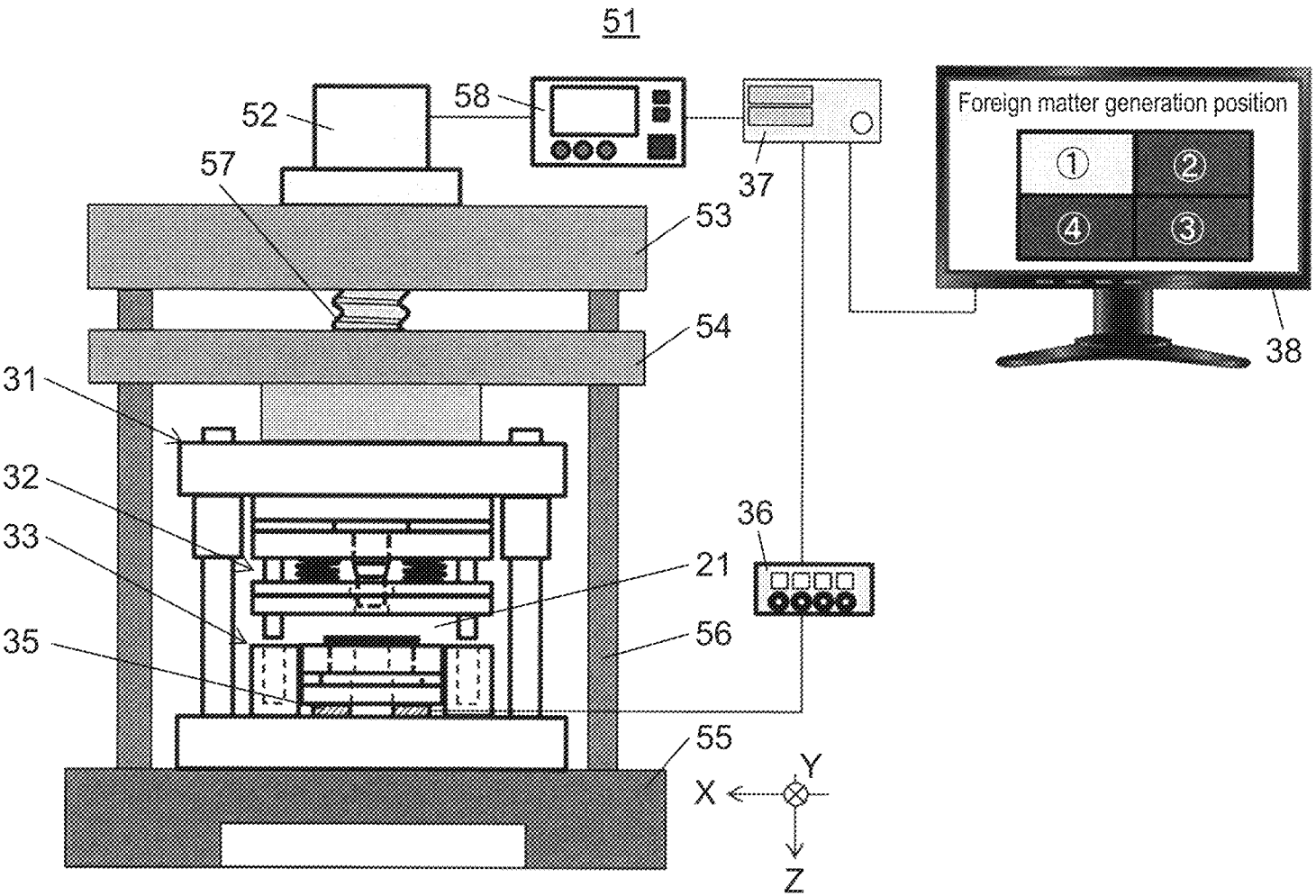
FIG. 1 is a block diagram illustrating a configuration example of a punching device according to a first exemplary embodiment.

In the punching device according to Japanese Patent Unexamined Publication No. 7-164075, in a case where foreign matter represented by the above-described punching scrap does not overlap the workpiece and is generated beside the workpiece, the distance between the upper mold and the lower mold does not change, and thus, foreign matter cannot be detected. In the punching device according to Japanese Patent Unexamined Publication No. 7-164075, in a case where the upper mold further includes a stripper that presses the workpiece before punching, when the punching cycle is shortened (faster), due to the rebound of the stripper or the like, there is a case where a change in distance is detected even though there is no foreign matter. Such error detection is not preferable because continuous punching is hindered and work efficiency deteriorates.

The present disclosure solves the above-described problems and provides a punching device capable of detecting foreign matter with higher accuracy as compared with the related art.

According to a first aspect of the disclosure, there is provided a punching device for punching a workpiece into a predetermined shape using a die including a mold with a hole having the predetermined shape and a punch including a mold having the predetermined shape, the device including: load sensors which are disposed respectively at positions where a force applied to the die is transmitted in the punching device, and measure a load in a punching direction at at least three predetermined points different from each other in the die; and a control device that calculates a first moment, which is a sum of moments of the measured load around a first axis, and a second moment, which is a sum of moments of the measured load around a second axis, with respect to the first and second axes on a plane perpendicular to the punching direction, and determines that foreign matter is generated in a case where a magnitude of at least one of the first and second moments is deviated from a range of predetermined values.

According to a second aspect of the disclosure, in the punching device according to the above-described first aspect, the first and second axes may be orthogonal to each other at a center of the hole of the die.

According to a third aspect of the disclosure, in the punching device according to the above-described first or second aspect, the range of predetermined values may be a range of values having a width of predetermined values in positive and negative directions, based on values of first and second initial moments, which are the first and second moments measured in advance when no foreign matter is generated.

According to a fourth aspect of the disclosure, in the punching device according to any one of the above-described first to third aspects, the control device may estimate in which of four quadrants divided by the first and second axes the foreign matter is generated, based on a magnitude relationship between the magnitude of the first moment and the magnitude of the first initial moment, and a magnitude relationship between the magnitude of the second moment and the magnitude of the second initial moment, when it is determined that the foreign matter is generated, and provide an estimation result to the user via the output device.

According to a fifth aspect of the disclosure, in the punching device according to any one of the above-described first to fourth aspects, a stripper that presses and holds the workpiece before the punching may further be provided.

According to a sixth aspect of the disclosure, in the punching device according to any one of the above-described first to fifth aspects, the control device may stop the punching of the punching device when it is determined that the foreign matter is generated.

In the punching device according to the present disclosure, foreign matter can be detected with higher accuracy than in the related art.

Hereinafter, a punching device according to a first exemplary embodiment will be described with reference to the drawings. In the drawings, substantially the same members will be given the same reference numerals. Components unnecessary for the description of the exemplary embodiment may be omitted without notice.

First Exemplary Embodiment

FIG. 1 is a block diagram illustrating a configuration example of punching device 51 according to the first exemplary embodiment of the present disclosure. In FIG. 1, punching device 51 includes servomotor 52, top plate 53, slider plate 54, base plate 55, slide bar 56, ball screw 57, control device 58, mold 31, a plurality of load sensors 35, load amplifier 36, computer 37, and display device 38.

In FIG. 1, servomotor 52 is disposed on top plate 53 and is driven and controlled by control device 58 to rotate. Ball screw 57 converts the rotation of servomotor 52 into a linear movement, and moves slider plate 54 up and down along slide bar 56.

Mold 31 includes upper mold 32 and lower mold 33. Lower mold 33 is fixed to base plate 55. Upper mold 32 is fixed to slider plate 54, and moves up and down with the movement of slider plate 54 described above. Punching is performed by sandwiching workpiece 21 between lower mold 33 and upper mold 32 that moves downward. The detailed configuration of mold 31 will be described later.

Four load sensors 35 are arranged on lower mold 33, the load applied to lower mold 33 is measured, and a load signal indicating the measured load is output to load amplifier 36. Load amplifier 36 amplifies the input load signal to obtain an amplified load signal, and outputs the amplified load signal to computer 37. Computer 37 determines whether or not foreign matter 22 is present inside mold 31 based on the input amplified load signal. When it is determined that foreign matter 22 is present, computer 37 controls control device 58 to stop the punching, or notifies the operator of the generation of foreign matter 22 via display device 38. When it is determined that foreign matter 22 is present, computer 37 may control device 58 to stop the punching, or further, notify the operator of the generation of foreign matter 22 via display device 38.

Figure 2A:
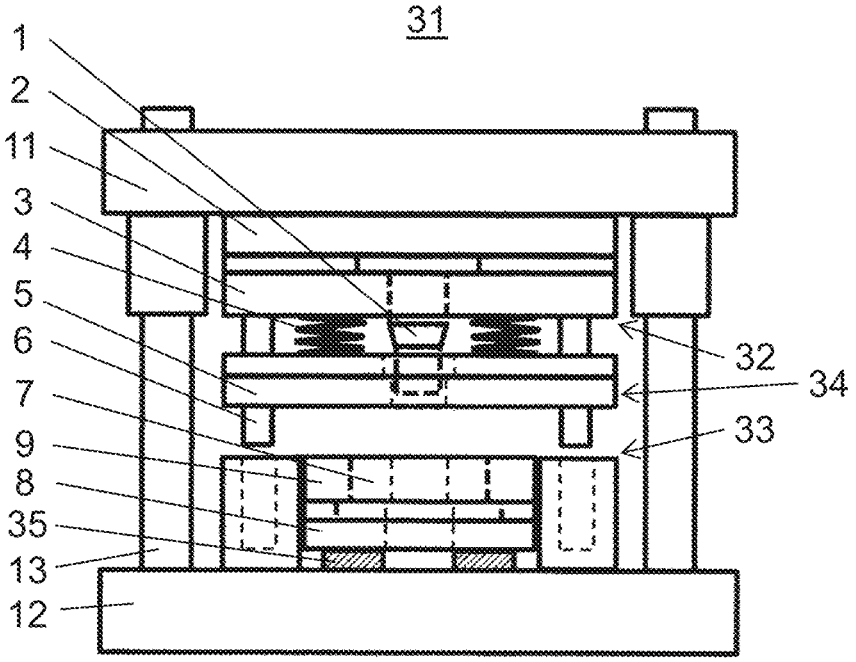
FIG. 2A is a side view illustrating a detailed configuration example of a mold of the punching device of FIG. 1.
Figure 2B:
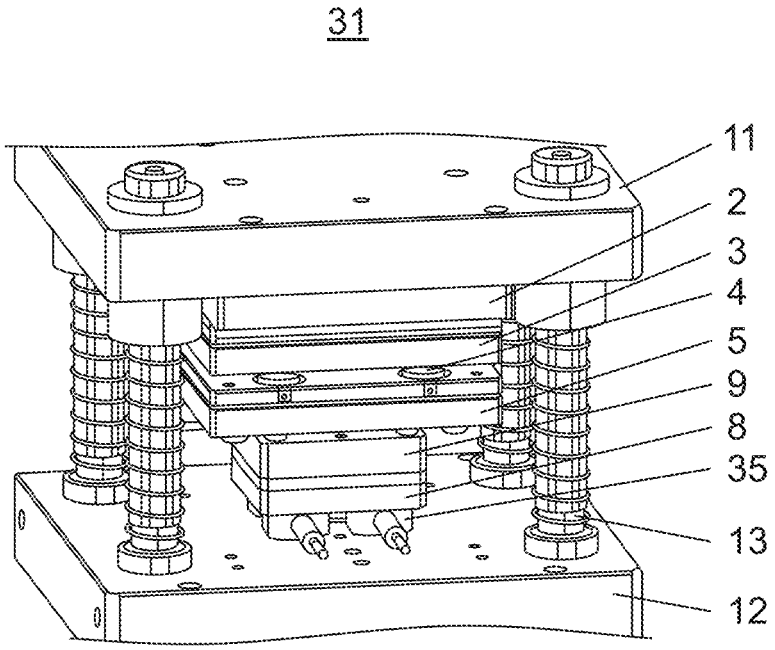
FIG. 2B is a perspective view illustrating a detailed configuration example of the mold of the punching device of FIG. 1.

FIG. 2A is a side view illustrating a detailed configuration example of mold 31 of FIG. 1. FIG. 2B is a perspective view illustrating a detailed configuration example of mold 31 of FIG. 1.

In FIG. 2A, mold 31 includes upper bolster 11, lower bolster 12, linear guide 13, upper mold 32, lower mold 33, and stripper part 34. Upper mold 32 includes punch 1, punch base 2 for fixing punch 1, and punch holder 3. Lower mold 33 includes die 7, die base 8 for fixing die 7, and die holder 9. Stripper part 34 is configured with stripper spring 4, stripper 5, and stripper guide 6.

Upper mold 32 moves up and down by being fixed to the upper bolster that moves up and down along linear guide 13. Die 7 has a hole having any predetermined shape such as a circle or a polygon. Punch 1 has a columnar shape having the same shape. Workpiece 21 (not illustrated) is sandwiched between die 7 and punch 1, and upper mold 32 is moved downward so as to introduce punch 1 into the hole of die 7, and accordingly, a hole in a shape of punch 1 is punched into workpiece 21.

Stripper 5 of stripper part 34 is disposed such that the lower surface thereof is positioned below the tip end of punch 1. Stripper 5 can move in the up-down direction along stripper guide 6. Stripper 5 comes into contact with workpiece 21 before punch 1 as upper mold 32 moves downward, and the elastic force of stripper spring 4 presses and holds workpiece 21 during the punching.

Four load sensors 35 are arranged between the lower surface of die base 8 and the upper surface of lower bolster 12. The detailed arrangement of load sensor 35 will be described later. Load sensor 35 measures the load applied to die 7 during the punching, and outputs a load signal indicating the measured load to load amplifier 36.

Figure 3:
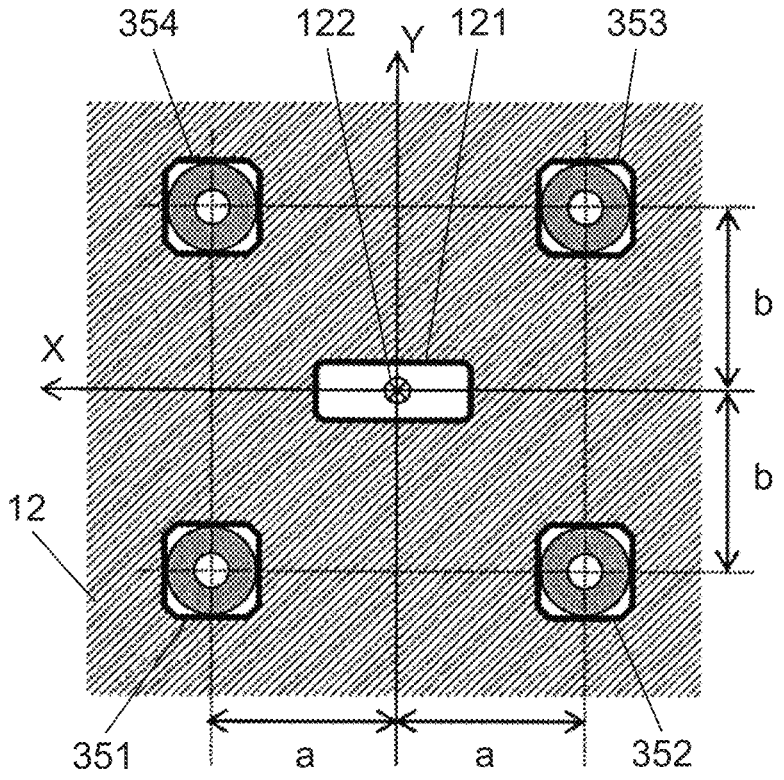
FIG. 3 is a top view illustrating an arrangement example of a load sensor of the punching device of FIG. 1.

FIG. 3 is a top view illustrating an arrangement example of load sensor 35 of punching device 51 of FIG. 1. In FIG. 3, the paper surface illustrates the upper surface of lower bolster 12. Elements unnecessary for the description except for lower bolster 12 and load sensor 35 are omitted.

In FIG. 3, in the exemplary embodiment, in punching device 51, four load sensors 35, such as load sensors 351 to 354, are arranged. Load sensors 351 to 354 are arranged such that the X-Y plane with punching shaft 122 at the center of hole 121 of die 7 as the origin is symmetrical with respect to both the X axis and the Y axis. Specifically, load sensors 351 to 354 are arranged in order respectively at each of the four points where the coordinates on the X-Y plane are (a, -b), (-a, -b), (-a, b), and (a, b) with respect to lengths a and b.

The load in the punching direction applied to load sensors 351 to 354 is represented by Fz1 to Fz4, respectively. At this time, the total punching load Fz, moment Mx around the X axis, and moment My around the Y axis are represented by the following equations, respectively.

$$Fz=Fz1+Fz2+Fz3+Fz4$$

$$Mx=b\ (-Fz1-Fz2+Fz3+Fz4) \quad (1)$$

$$My=a\ (-Fz1+Fz2+Fz3-Fz4) \quad (2)$$

However, moment Mx around the X axis is considered as positive in the clockwise direction with respect to the X-axis positive direction, and moment My around the Y axis is considered as positive in the clockwise direction with respect to the Y-axis positive direction.

In a case where load sensors 351 to 354 are not arranged symmetrically with respect to the X axis and the Y axis, the equation for this moment becomes more complicated. In order to stably support die base 8, load sensors 351 to 354 are preferably arranged symmetrically.

The foreign matter detecting operation of punching device 51 configured as described above will be described below with reference to FIGS. 4A to 7.

In the exemplary embodiment, as foreign matter 22, the punching scrap generated by the phenomenon called "scrap floating" is assumed. The scrap floating is a phenomenon in which the punching scrap generated during the punching adheres to punch 1 due to, for example, electrostatic force, surface tension, and the like, and is removed from punch 1 after the punching is completed, and accordingly, foreign matter 22 is generated on workpiece 21 or die 7. Scrap floating occurs particularly frequently in a case where workpiece 21 is a thin plate having a thickness of 0.1 mm or less, or in a case where a small hole having a small punching shape is punched. It is considered that this is because the mass of the generated punching scrap is small and the punching scrap easily adheres to punch 1 due to the surface tension, magnetic force, electrostatic force, and the like of the lubricating oil.

Figure 4A:
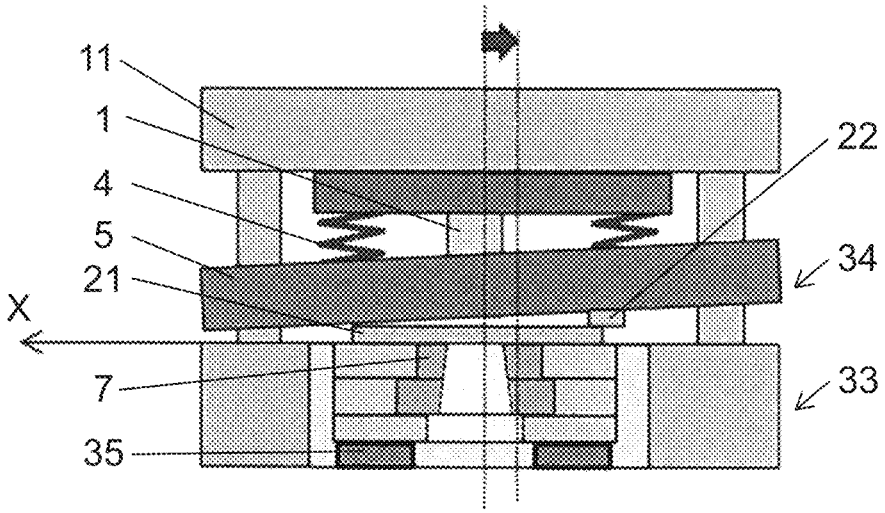
FIG. 4A is a side view illustrating an operation example of a case where foreign matter is generated on a workpiece in the punching device of FIG. 1.

FIG. 4A is a side view illustrating an appearance example of a case where foreign matter 22 is generated on the upper surface of workpiece 21. Since foreign matter 22 is generated on the upper surface of workpiece 21 on the negative side of the X axis, and accordingly, stripper 5 that presses workpiece 21 is in contact with foreign matter 22 thereon instead of workpiece 21. Of stripper springs 4 connected to stripper 5, those in the X-axis negative direction shrink more than those in the positive direction by the thickness of foreign matter 22. Therefore, the load applied to die 7 by stripper 5 in the punching direction increases toward the negative side in the X axis. Due to the generation of foreign matter 22, as illustrated by the arrow in FIG. 4A, the center of gravity of the object on die 7 is biased in the X-axis negative direction, and thus, the load applied to die 7 in the punching direction by workpiece 21 and foreign matter 22 also becomes larger on the negative side (Fz2, Fz3) of the X axis than on the positive side (Fz1, Fz4).

Figure 4B:
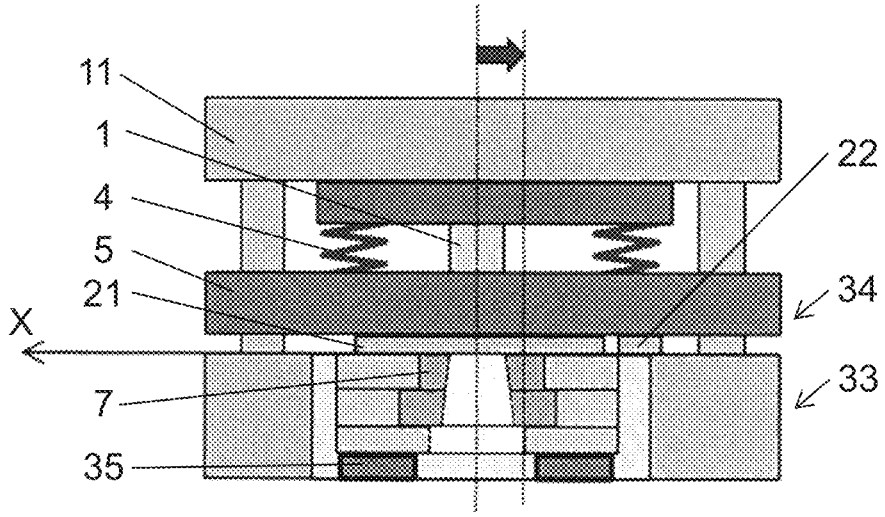
FIG. 4B is a side view illustrating an operation example of a case where foreign matter is generated beside the workpiece in the punching device of FIG. 1.

FIG. 4B is a side view illustrating an appearance example of a case where foreign matter 22 is generated beside workpiece 21, that is, directly on die 7. Unlike the case of FIG. 4A, stripper 5 comes into contact with workpiece 21 horizontally, and thus, the load is not biased by stripper spring 4. Meanwhile, since foreign matter 22 is generated on the negative side of the X axis of workpiece 21, similar to FIG. 4A, as illustrated by the arrow in FIG. 4B, the center of gravity of the object on die 7 is biased in the X-axis negative direction, and the load (Fz2, Fz3) on the negative side of the X axis becomes larger than that on the positive side (Fz1, Fz4).

The values of measured loads Fz1 to Fz4 of load sensors 351 to 354 are output to load amplifier 36 as load signals indicating measured loads Fz1 to Fz4, respectively. Load amplifier 36 amplifies the load signal to obtain an amplified load signal, and outputs the amplified load signal to computer 37.

Figure 5A:
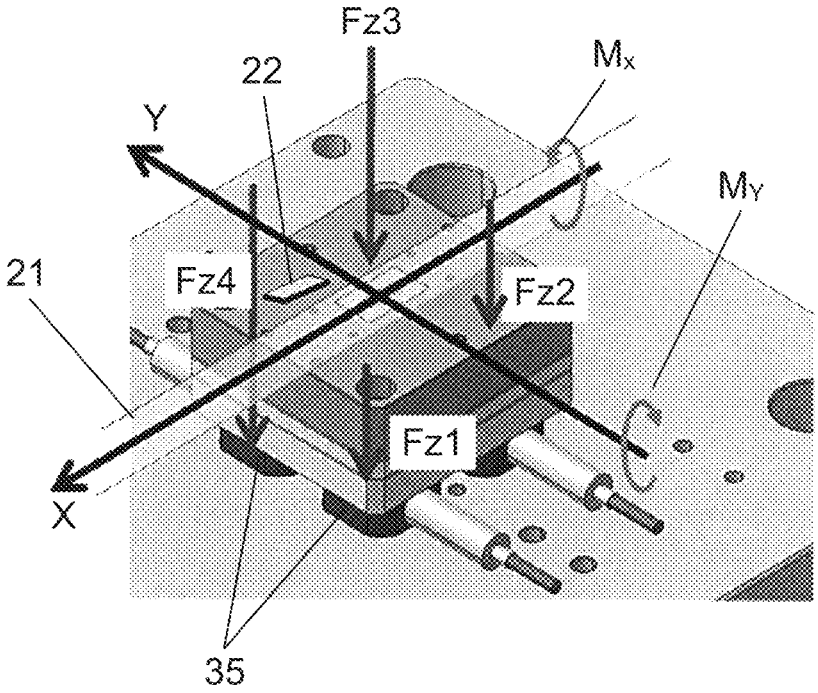
FIG. 5A is a perspective view illustrating an example of a force and a moment in a foreign matter detecting operation in the punching device of FIG. 1.

FIG. 5A is a view illustrating the relationship between loads Fz1 to Fz4 and moments Mx and My around the X axis and the Y axis when foreign matter 22 is generated without overlapping workpiece 21. In FIG. 5A, moments Mx and My around the X axis and the Y axis of the load are moments in which the clockwise direction with respect to each axis is positive, respectively, indicated by the arrows in the drawing. In a case where foreign matter 22 is not generated, measured loads Fz1 to Fz4 of load sensors 351 to 354 arranged symmetrically with respect to the X axis and the Y axis all have the same value. Therefore, when moments Mx and My are calculated according to the equations (1) and (2), Mx=0 and My=0 are substantially established. Such moments Mx and My in a case where no foreign matter 22 is generated are called initial moments Mx0 and My0.

In FIG. 5A, a case is considered in which, in die 7, in a region (first quadrant) where both the X and Y coordinates are positive, foreign matter 22 is generated without overlapping workpiece 21. As described above regarding FIG. 4B, since the position of the center of gravity of the object on die 7 is biased toward foreign matter 22, the load applied to load sensors 351 to 354 becomes larger as foreign matter 22 is generated. Therefore, measured load Fz4 of load sensor 354 on foreign matter 22 side with respect to the X axis becomes larger than measured load Fz1 of load sensor 351 on the opposite side, and similarly, measured load Fz3 of load sensor 353 becomes larger than measured load Fz2 of load sensor 352. Similarly, regarding the Y axis, measured load Fz4 becomes larger than measured load Fz3, and measured load Fz1 becomes larger than measured load Fz2.

When moments Mx and My are calculated according to the equations (1) and (2) using these measured loads Fz1 to Fz4, Mx>0 and My<0 are established. Computer 37 determines that foreign matter 22 is generated in a case where at least one of moments Mx and My is not 0.

A case is considered in which foreign matter 22 is generated in another quadrant of die 7. In a case where foreign matter 22 is generated in the second quadrant (a region where the X coordinate is negative and the Y coordinate is positive) of die 7, measured load Fz3 becomes large and measured load Fz1 becomes small, and thus, when moments Mx and My are calculated based on the equations (1) and (2), Mx>0 and My>0 are established. Similarly, in a case where foreign matter 22 is generated in the third quadrant (a region where both X and Y coordinates are negative) of die 7, Mx<0 and My>0 are established, and in a case where foreign matter 22 is generated in the fourth quadrant (X coordinate is positive and Y coordinate is negative) of die 7, Mx<0 and My<0 are established. Therefore, by confirming whether moments Mx and My are positive or negative around the X axis and the Y axis, it is possible to estimate in which quadrant of die 7 foreign matter 22 is generated.

Figure 5B:
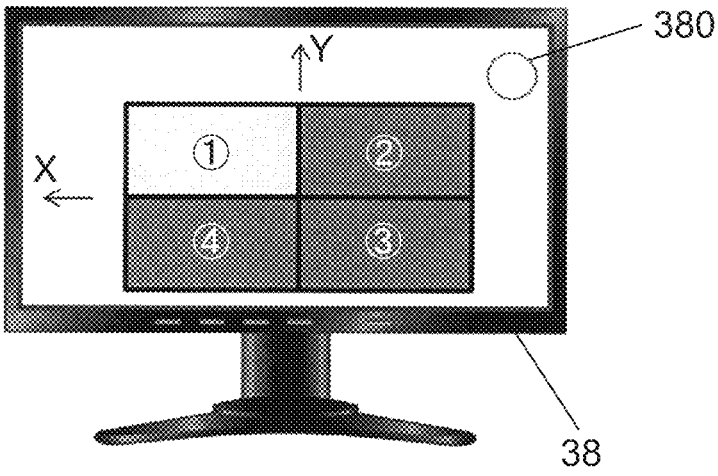
FIG. 5B is a front view illustrating a display example of a display device in the foreign matter detecting operation in the punching device of FIG. 1.

Computer 37, which determined that foreign matter 22 was generated, estimates in which quadrant foreign matter 22 is generated as described above, controls display device 38, displays screen 380 as illustrated in FIG. 5B, warns the operator, and controls control device 58 to stop the operation of punching device 51. On screen 380, frames corresponding to the first to fourth quadrants of die 7 are displayed, and the frames corresponding to the quadrants in which foreign matter 22 is estimated to be generated are displayed in a warning color different from that of the others. By looking at screen 380, the operator can confirm in which quadrant of die 7 foreign matter 22 is generated and remove foreign matter 22.

In the exemplary embodiment, the moments around the X axis and the Y axis are used to estimate where foreign matter 22 is generated in the region divided into four by the X and Y axes. However, when there are at least three load sensors 35, the purpose of estimating the position of foreign matter 22 can be achieved. However, when multiple load sensors are used, the detection accuracy of foreign matter 22 can be improved, and the region of die 7 can be divided into more regions to estimate the more detailed position of foreign matter 22.

In FIG. 5B, display device 38 is a display device such as a liquid crystal display. However, any display device may be used as long as the display device can notify the operator in which of the plurality of regions divided from the region of die 7 foreign matter 22 is generated. For example, the operator can be notified of the generation position of foreign matter 22 by using four LED lamps arranged on punching device 51.

Figure 6:
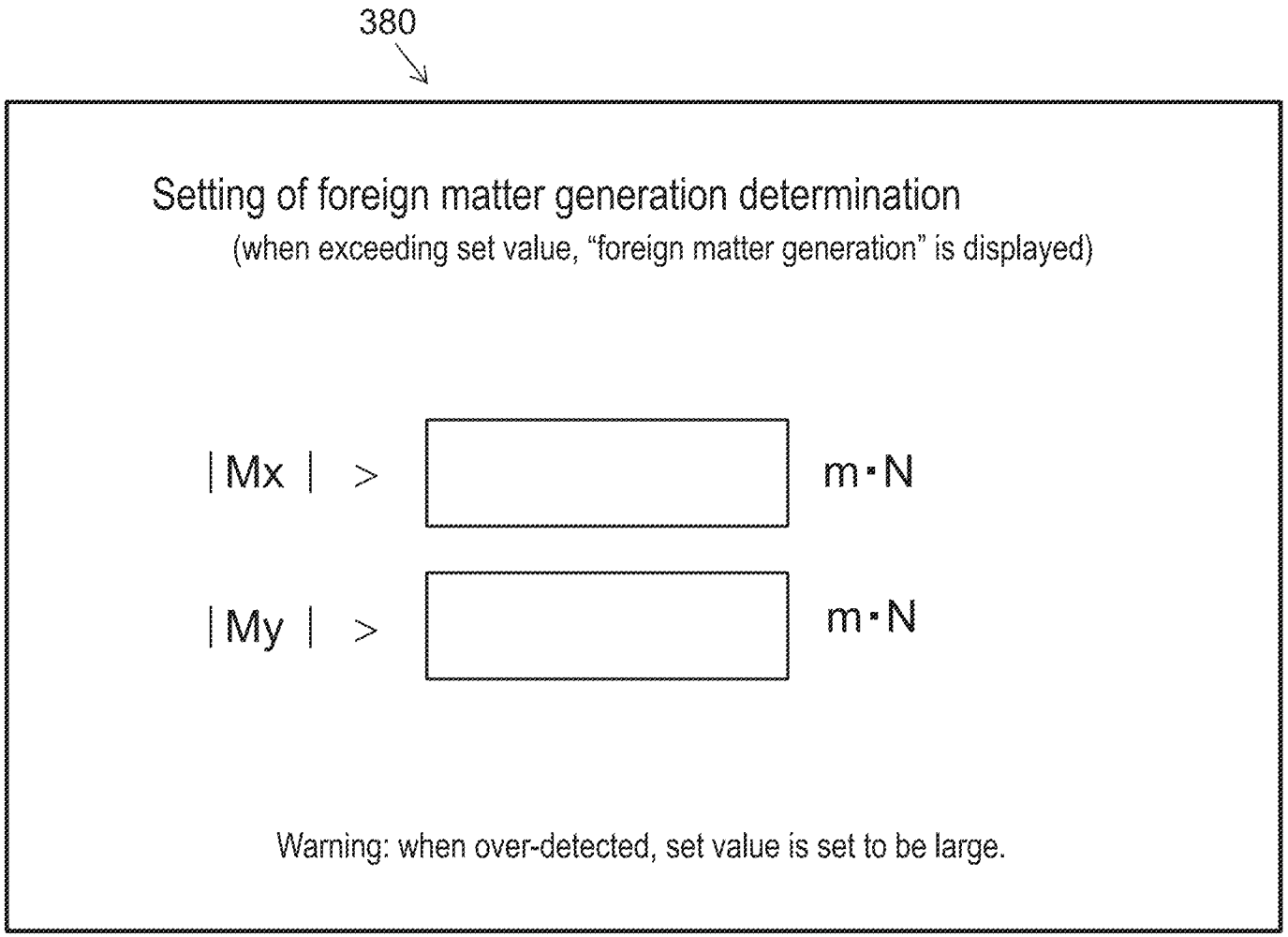
FIG. 6 is a view illustrating a display example of a setting screen of a foreign matter detection threshold value in the punching device of FIG. 1.

FIG. 6 is a front view illustrating a display example of a setting screen for determining generation of the foreign matter. In the procedure for determining that foreign matter 22 is generated, when it is determined that foreign matter 22 is generated in a case where the values of moments Mx and My are not 0, it is considered that a slight measurement error or shaking will be erroneously detected as the generation of foreign matter 22. Therefore, punching device 51 in the exemplary embodiment determines that foreign matter 22 is generated in a case where at least one of the absolute values of moments Mx and My is larger than a predetermined threshold value. This threshold value can be set by presenting a screen illustrated in FIG. 6, for example, to the operator and having the operator input the threshold value for moments Mx and My.

Since initial moments Mx0 and My0 were 0 in the exemplary embodiment, the quadrant of die 7 in which foreign matter 22 was generated was estimated depending on positive and negative moments Mx and My. However, there is a case where initial moments Mx0 and My0 are not 0 depending on the arrangement number and arrangement location of load sensors 35. In this case, the same estimation can be performed based on the magnitude relationship between moments Mx and My and initial moments Mx0 and My0. In this case, the threshold value for moment Mx may be set not for the absolute value |Mx| of moment Mx but for the absolute value |Mx−Mx0| of the difference between moment Mx and initial moment Mx0. The upper limit value and the lower limit value may be set individually, and in a case where the magnitude of moment Mx exceeds the range of the values, it may be determined that foreign matter 22 was generated. This also applies to moment My.

In the exemplary embodiment, in a case where the absolute values of moments Mx and My exceed the threshold value, it is determined that foreign matter 22 was generated, a warning is displayed on display device 38, and control device 58 is controlled to stop punching device 51. However, each different threshold value may be set for displaying a warning and stopping punching device 51. For example, it is assumed that a warning is displayed in a case where the absolute value of moment Mx exceeds 1.0 m•N, and punching device 51 is stopped in a case where the absolute value exceeds 2.0 m•N.

FIG. 7 is a table illustrating an operation example of punching device 51. In FIG. 7, the threshold value illustrated in FIG. 6 is set as a threshold value for determining the generation of foreign matter 22. The "number of punches" indicates the number of times of performing the punching with respect to workpiece 21. The values in the column "moment difference" indicate the difference between moments Mx and My and initial moment Mx0 and My0. "Determination" indicates determination result on whether or not any of the above moment differences with respect to the X and Y axes exceeds the threshold value, that is, whether or not foreign matter 22 is generated. "NG" indicates that the moment difference exceeded the threshold value, and "OK" indicates that the moment difference did not exceed the threshold value. "Response" indicates a response automatically taken by punching device 51 in response to the above-described determination result.

In FIG. 7, since none of the moment difference values exceeded the threshold value during the first punching, it was determined that no foreign matter 22 was generated, and the punching was continued as it was. At the time of the second punching, it was determined that the value of the moment difference with respect to the Y axis exceeded the threshold value and foreign matter 22 was generated. Therefore, a warning was displayed to the operator based on the sign of the moment difference for each of the X and Y axes, and the punching was stopped.

After this, after receiving a warning and removing foreign matter 22, the operator starts the operation of punching device 51 again to perform the third punching. In the third punching, none of the moment difference values exceed the threshold value, it was determined that no foreign matter 22 was generated, and the punching was continued.

In this manner, punching device 51 according to the exemplary embodiment measures the load applied to die 7 by load sensors 351 to 354, and calculates moments Mx and My based on measured loads Fz1 to Fz4. After this, it is determined whether or not foreign matter 22 is generated based on the difference in magnitude between calculated moments Mx and My and initial moments Mx0 and My0. In a case where foreign matter 22 is generated, punching device 51 displays the determination result including the quadrant of die 7 in which foreign matter 22 is generated to the operator, or stops the punching of punching device 51. In a case where foreign matter 22 is generated, punching device 51 may display the determination result including the quadrant of die 7 in which foreign matter 22 is generated to the operator, and further stop the punching of punching device 51. Accordingly, even in a case where foreign matter 22 is generated in a place where foreign matter 22 does not overlap workpiece 21, the generation of foreign matter 22 can be detected and the punching can be stopped. By knowing the place where foreign matter 22 is generated in advance, the operator can smoothly remove foreign matter 22 and restart the next punching.

In the exemplary embodiment, the punching scrap generated by "scrap floating" is assumed as foreign matter 22, but punching device 51 can detect not only the scrap floating but also, for example, the mixing of foreign matter from the outside. At least two of load amplifier 36, computer 37, display device 38, control device 58, and the like of the exemplary embodiment may be configured as the same element.

Furthermore, in the exemplary embodiment, load sensor 35 is disposed below die base 8, but may be disposed anywhere as long as the load applied to three or more points of the die is transmitted, respectively. For example, a plurality of load sensors 35 may be disposed on stripper part 34.

The punching device of the disclosure can detect foreign matter even in a case where the distance between the stripper and the lower mold does not change, such as when foreign matter is placed next to the workpiece, or in a case where the punching cycle is accelerated, and despite the high detection sensitivity, there are few error detection. Therefore, it is possible to provide a punching device capable of performing highly accurate foreign matter detection without reducing the productivity of the punching work. The punching device of the present disclosure can also be applied to punching of films and composite materials.

What is claimed is:

1. A punching device for punching a workpiece into a predetermined shape using a die and a punch, the die including a mold with a hole having the predetermined shape, and the punch including a mold having the predetermined shape, the device comprising:

load sensors which are disposed respectively at positions where a force applied to the die is transmitted in the punching device, and measure a load in a punching direction at each of at least three predetermined points different from each other in the die; and a control device that calculates a first moment, which is a sum of moments of the measured load around a first axis, and a second moment, which is a sum of moments of the measured load around a second axis, with respect to the first and second axes on a plane perpendicular to the punching direction, and determines that foreign matter is generated in a case where a magnitude of at least one of the first and second moments is deviated from a range of predetermined values.

2. The punching device of claim 1, wherein the first and second axes are orthogonal to each other at a center of the hole of the die.

3. The punching device of claim 1, wherein the range of predetermined values is a range of values having a width of predetermined values in positive and negative directions, based on values of magnitudes of first and second initial moments which are the first and second moments, respectively, measured in advance when no foreign matter is generated.

4. The punching device of claim 3, further comprising:

an output device configured to provide various information to a user, wherein the control device estimates in which of four quadrants divided by the first and second axes the foreign matter is generated, based on a magnitude relationship between the magnitude of the first moment and the magnitude of the first initial moment, and a magnitude relationship between the magnitude of the second moment and the magnitude of the second initial moment, when it is determined that the foreign matter is generated, and provides an estimation result to the user via the output device.

5. The punching device of claim 1, further comprising:

a stripper that presses and holds the workpiece before the punching.

6. The punching device of claim 1, wherein the control device stops the punching of the punching device when it is determined that the foreign matter is generated.

* * * * *